United States Patent [19]

Hasegawa et al.

[11] Patent Number: 5,052,734

[45] Date of Patent: Oct. 1, 1991

[54] LIFTING SPREADER COMPENSATING MECHANISM

[75] Inventors: Shuji Hasegawa; Hans G. Vosskamp, both of San Mateo, Calif.

[73] Assignee: Paceco Corp., San Mateo, Calif.

[21] Appl. No.: 510,280

[22] Filed: Apr. 17, 1990

[51] Int. Cl.[5] ..... B66C 1/00; B66F 9/00

[52] U.S. Cl. ..... 294/81.2; 294/81.53

[58] Field of Search ..... 294/81.21, 81.2, 81.4, 294/81.53, 81.3, 119.2

[56] References Cited

U.S. PATENT DOCUMENTS 3,544,149 12/1970 Saarinen ..... 294/81.004

3,750,814 8/1973 Allegri et al. ..... 294/81.021

FOREIGN PATENT DOCUMENTS 1426929 9/1988 U.S.S.R. ..... 294/81.002

OTHER PUBLICATIONS

Liftech Consultants, Telescopic Spreader, 1983 Arc Welding Design.

*Primary Examiner*—Russel D. Stormer

*Assistant Examiner*—Cathleen G. Pringle

*Attorney, Agent, or Firm*—Bruce & McCoy

[57] ABSTRACT

A cargo container lifting spreader compensating mechanism for facilitating engagement by the spreader with cargo containers having out-of-plane twistlock engagement receptacles, the invention comprising cross-members for carrying the twistlock lug members secured at the ends of the spreaders with rotatable connections whereby they are partially rotatable in a vertical plane perpendicular to the longitudinal axis of the spreader with a restrictor means to limit said rotation.

5 Claims, 5 Drawing Sheets

LIFTING SPREADER COMPENSATING MECHANISM

BACKGROUND OF THE INVENTION

1. Field of the Invention

The present invention relates to cargo container lifting spreader compensating mechanisms, and more particularly, to a lifting spreader compensating mechanism for facilitating the engagement by the spreader with cargo containers having outof-plane twistlock engagement receptacles.

2. Description of the Prior Art

One of the problems for cargo container handling equipment which has been particularly difficult to accommodate is the engagement of damaged cargo containers by the standard equipment when the twistlock engagement receptacles formed in the top corners of the cargo containers have been moved out of alignment by deformation of the cargo container.

Another problem in cargo container handling results from designs for lifting spreaders which permit unequal loading of the twistlock mechanisms which shortens the life expectancy of the overloaded lug members.

A standard cargo container lifting spreader is designed to accommodate vertical twistlock misalignment of plus or minus one-quarter ($\pm\frac{1}{4}$) inch. Therefore, if a cargo container has been damaged, usually by dropping or overloading, it is possible that the positioning of the twistlock engagement receptacles at the upper corners of the cargo container have been moved out of the plane of alignment in the upper surface of the cargo container by deformation thereof. If this occurs, the cargo container is thereby generally rendered unusable, but it is often the case that the condition occurs at a time when it is still necessary to engage the container in order to be able to move it to a destination where it can be unloaded and then taken out of service. In addition, some cargo containers are deformed out of alignment by simple overloading or in such a small manner that it is not easily noticeable or readily detectable, whereby the container remains in service and must be handled by the standard equipment. It is therefore necessary to make the equipment adaptable to be able to accommodate cargo containers which are slightly out of alignment as well as those that are substantially out of alignment in the extreme circumstance.

The prior art has not provided any means to accommodate deformed cargo containers which exceed the tolerance of plus or minus one-quarter ($\pm\frac{1}{4}$) inch of misalignment of the twistlock receptacles disposed at the corners of the cargo container. In such a situation, the twistlock lug members will not engage the container or possibly not unlock if the damage occurs after the container has been lifted or engaged.

In an effort to reduce weight and increase adaptability for handling different lengths of containers, the design of cargo container lifting spreaders is tending toward a single telescoping beam with end cross-members which carry the twistlock male members. The simplest form of this design is a sliding beam which is comprised of two offset members disposed parallel to each other and which overlap in the middle portion of the beam. They are interconnected at the center of the beam with a reciprocating mechanism which actuates the two members causing them to slide back and forth with respect to each other whereby their combined length can be telescoped from one length to another.

The inherent problem with the design is that the end cross-members are attached to the offset sliding members at positions which are not at the center of gravity of the end cross-members. This offset attachment results in a moment or torque in each member of the sliding member. However, the two sliding members experience opposite torques whereby they are offsetting and the system is balanced. Unfortunately, the design results in unequal loading of the twistlocks and excessive wear of the overloaded twistlock lug members disposed at the ends of the cross-members. In addition, it suggests to some purchasers of the spreader design that the twistlock lug members might hang out of plane under the spreader.

The present invention uniquely provides a solution to the diverse problems caused both by damaged cargo containers and by designs of lifting spreaders which permit unequal loading of the twistlocks, and it can be adapted to most types or designs of lifting spreaders.

SUMMARY OF THE INVENTION

The present invention is a cargo container lifting spreader compensating mechanism. It includes a lifting spreader having a central lifting beam and a pair of cross-members disposed at the opposite ends of the central lifting beam. The cross-members are secured to the lifting beam with journaled connections which allow at least partial rotation of the cross-members in a plane perpendicular to the longitudinal axis of the beam. The cross-members have twistlock lug members which are mounted proximate to the lower ends of the cross-members for mating with the twistlock engagement receptacles of the cargo container corner castings. A restrictor means is provided for preventing excessive rotation of the cross-members with respect to the central beam at least when the spreader is in the process of engaging a cargo container.

OBJECTS OF THE INVENTION

It is therefore an important object of the present invention to provide a new and novel cargo container lifting spreader compensating mechanism which permits engaging out-of-plane twistlock engagement receptacles on a cargo container.

It is another object of the present invention to provide a new and novel cargo container lifting spreader compensating mechanism which eliminates unequal loading of the twistlocks.

It is a further object of the present invention to provide a new and novel cargo container lifting spreader compensating mechanism which prevents uneven wear of the twistlock lug members.

It is still another object of the present invention to provide a new and novel cargo container lifting spreader compensating mechanism which maintains the twistlock lug members at each end of the spreader in a level plane when the spreader is unloaded or not attached to a container.

It is still a further object of the present invention to provide a cargo container lifting spreader compensating mechanism which allows the twistlock lug members to rotate in a vertical plane disposed perpendicular to the longitudinal axis of the spreader.

It is yet another object of the present invention to provide a new and novel lifting spreader compensating mechanism for engaging cargo containers having out-of-plane twistlock engagement receptacles which has an adjustable restrictor means for permitting limited rotational movement of the twistlock lug members relative to the container and which can be adjusted to lock up the compensating mechanism or greatly increase its limits of operation beyond normal.

Other objects and advantages of the present invention will become apparent when the description of the preferred embodiment of the invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
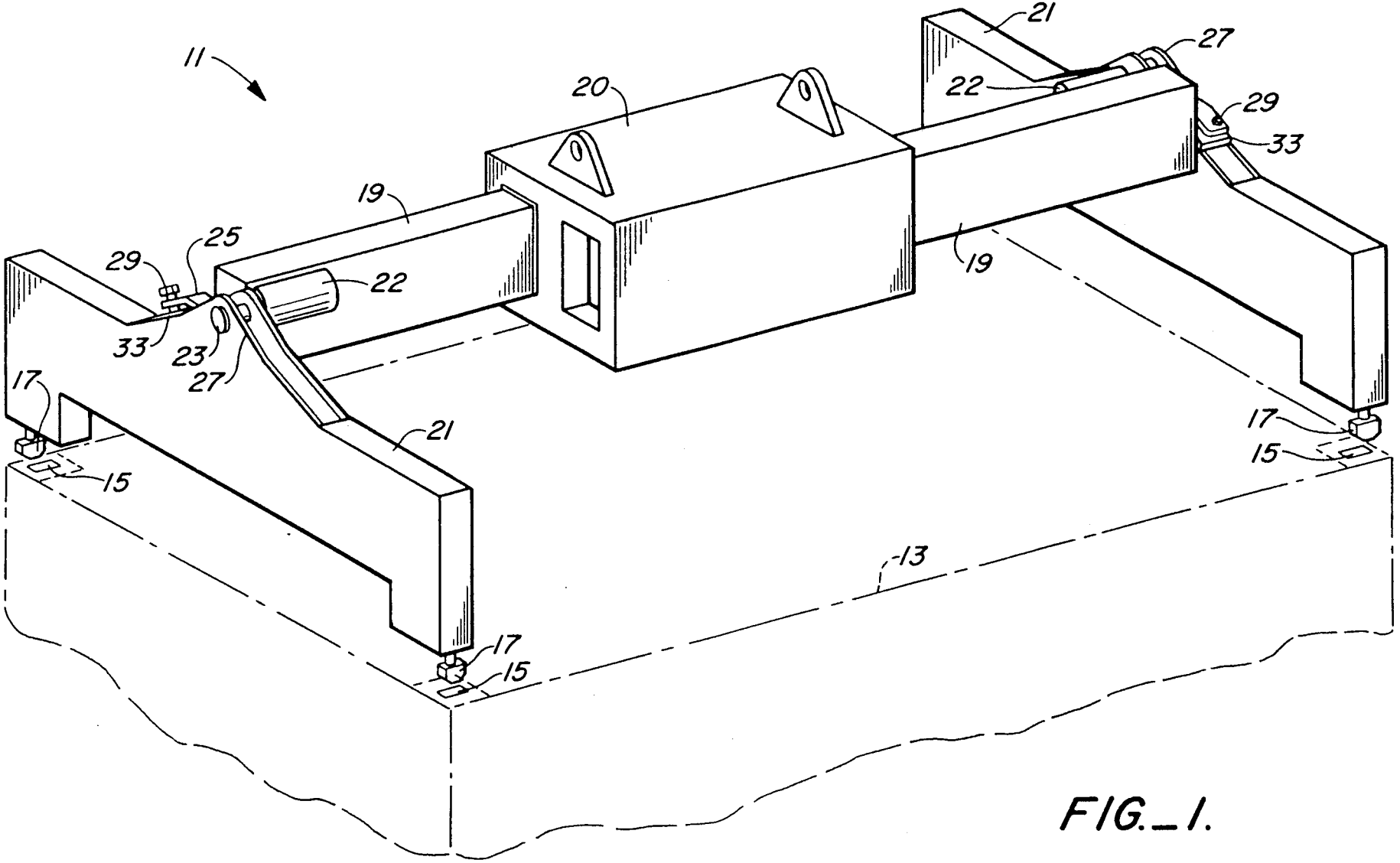
FIG. 1 is a perspective view illustrating an extensible cargo container lifting spreader and showing the present invention.

FIG. 1 is a perspective view of a generic representation of an extensible lifting spreader 11 which is utilized for engaging and lifting cargo containers 13. The spreader is suspended from the gantry of a crane by wire rope reeving and engages a cargo container by means of twistlocks which engage the corners of the cargo containers. The cargo containers are provided with universal type female twistlock engagement receptacles 15 formed in the upper corner castings of the cargo container. The lifting spreaders are provided with male twistlock lug members 17 disposed at the lower corners of the lifting spreader which are positioned to engage the twistlock receptacles on the container.

Cargo container lifting spreaders come in a great variety of forms. Some are of fixed length while others telescope to various lengths. Almost all cargo containers are standard in their height and width dimensions of eight feet. The standard lengths vary between twenty and forty-five feet. While the illustration of FIG. 1 is a cargo container lifting spreader utilizing an extensible central lifting beam, it could also be a rectangular or fixed framework or any other extensible configuration which extends proximate to the ends of the container. The central beam of a generic adjustable type lifting spreader employs a pair of beams or members 19 mounted side by side and which are interconnected by means of a control mechanism 20 which reciprocates the beams with respect to each other to extend or shorten the length of the combined beams which form the central beam. Cross-members 21 are disposed at the ends of the central lifting beam for positioning the twistlock lug members 17 at the proper width which is a fixed distance. In the prior art, the cross-members would be fixed to the ends of the parallel members at offset positions along the cross-members. In the present invention, the connection of the cross-members is at a point on the center of gravity line called the centerline. An offset mount 22 for the connection is provided on each sliding member.

The lug members 17 disposed at the lower corners of the lifting spreader are formed to penetrate into the corner castings of the cargo container which are the twist lock receptacles 15. After the shanks of the twistlock lug members have penetrated the receptacles, they are rotated 90 degrees whereby the lugs which project from the sides of the shanks rotate underneath overhanging projections in the corner receptacles whereby the lugs are trapped in the corner receptacles and the shanks cannot be withdrawn until they are re-rotated 90 degrees to put the lugs in alignment with the receptacle openings.

The tolerances for the twistlock engagement mechanisms allow a vertical movement of plus or minus one-quarter ($\pm\frac{1}{4}$) inch between the receptacles 15 and the lug members 17 providing a loose fit of steel on steel. Thus, if there is damage to the cargo container 13 whereby it is distorted causing a container to have an out-of-plane upper surface with more than one-quarter ($\frac{1}{4}$) inch of deviation from side to side at the ends of the container, or with respect to the two twistlock lug members disposed at the corners of a cross-member on a lifting spreader, then the twistlocks will not engage (or possibly not disengage if the damage occurs while the locks are engaged). The present invention was designed for the purpose of overcoming this problem and can be used with any type of spreader which can accommodate the modifications or features described herein.

The compensating mechanism of the present invention comprises a lifting spreader 11 having a central lifting beam comprised of the two reciprocating members 19 and a pair of cross-members 21 disposed at the opposite ends thereof. The central lifting beam can be a single fixed length beam, a rectangular framework, and any type of variable length lifting spreader configuration. The innovative portion of the design is that the cross-members are secured to the central beam with journaled connections 23 which allow at least partial rotation of the cross-members with respect to the central beam in a plane perpendicular to the longitudinal axis of the beam. It is preferable that the journal connection be located at the centerline of the cross-member in order for the twistlock lug members 17 to hang at the same level or in the same plane which is the neutral position. The present invention also provides a means to insure that this condition occurs.

In the preferred embodiment, both cross-members at the ends of the lifting beam are journaled thereto although it is possible that only one end need be journaled in order to effect the results of the present invention so long as both cross-members are secured to the central beam at their centerlines. In such an arrangement, if the damage to the container occurs at the end of the spreader having a fixed cross-member, the whole spreader has to rotate on its longitudinal axis to effect the engagement. This is less flexible than having both end cross-members rotatable and thereby adaptable to damaged containers in which either end may be distorted.

A restrictor means is provided for limiting or preventing excessive rotation of the cross-members with respect to the central beam at least when the spreader is in the process of engaging the cargo container. The means can be unlocked when the container is engaged but in normal operation is not. The restrictor means allows vertical movement of the twistlock lug members approximately plus or minus two (±2) inches from the neutral position in its operating condition. The restrictor means can be adjusted in extreme conditions to allow greater limits of rotation or even be unlocked to engage badly distorted cargo containers by increasing as desired the range of operation permitted by the restrictor means. Normally, the restrictor means is adjusted to a limited mode of operation when handling normal cargo containers to prevent excessive rotation of the cross-members by external forces which might permit damage to occur to the twistlock engagement means or misalignment when attempting to effect engagement of the spreader with a cargo container.

Figure 2:
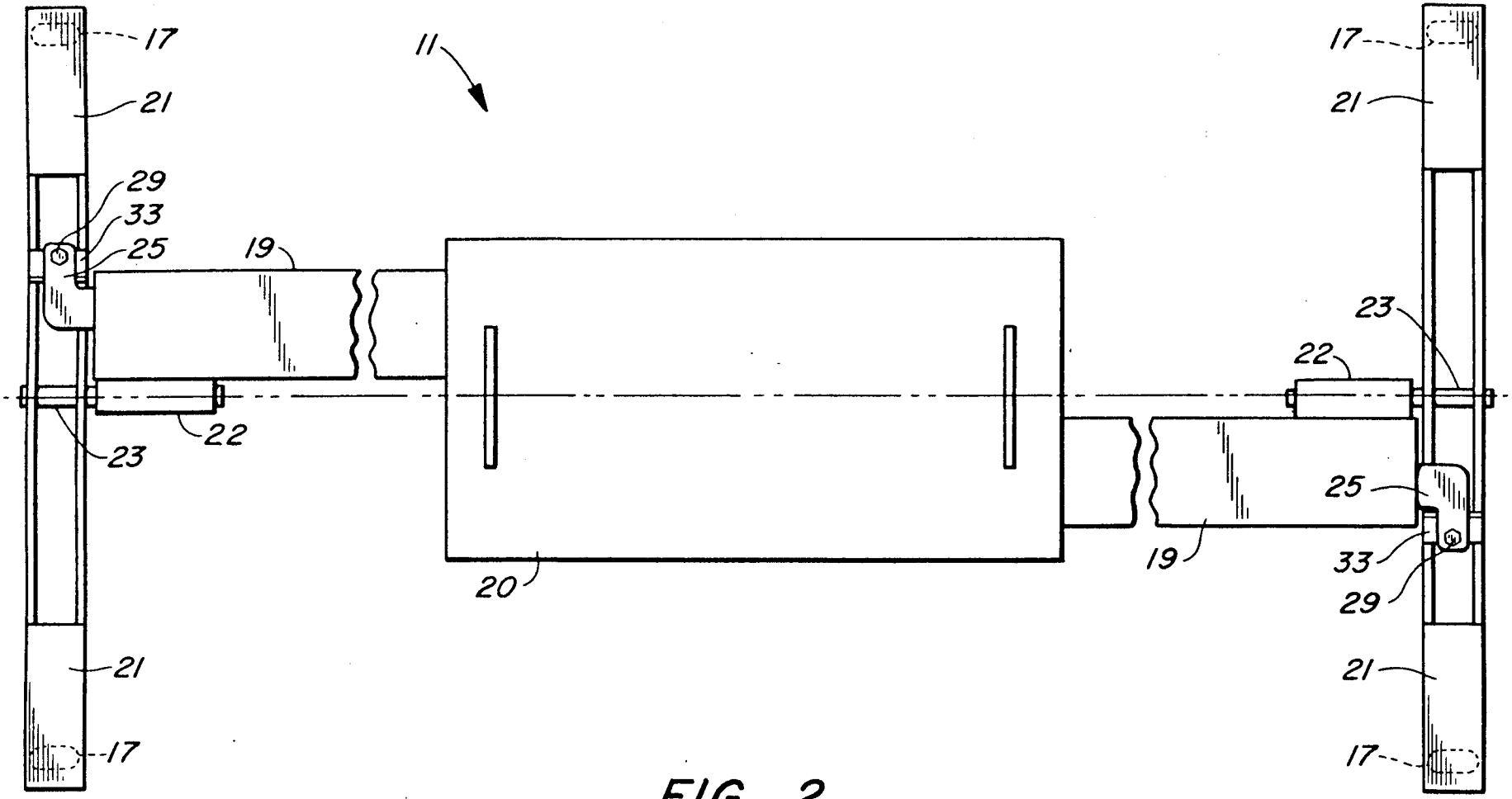
FIG. 2 is a top plan view of FIG. 1.
Figure 3:
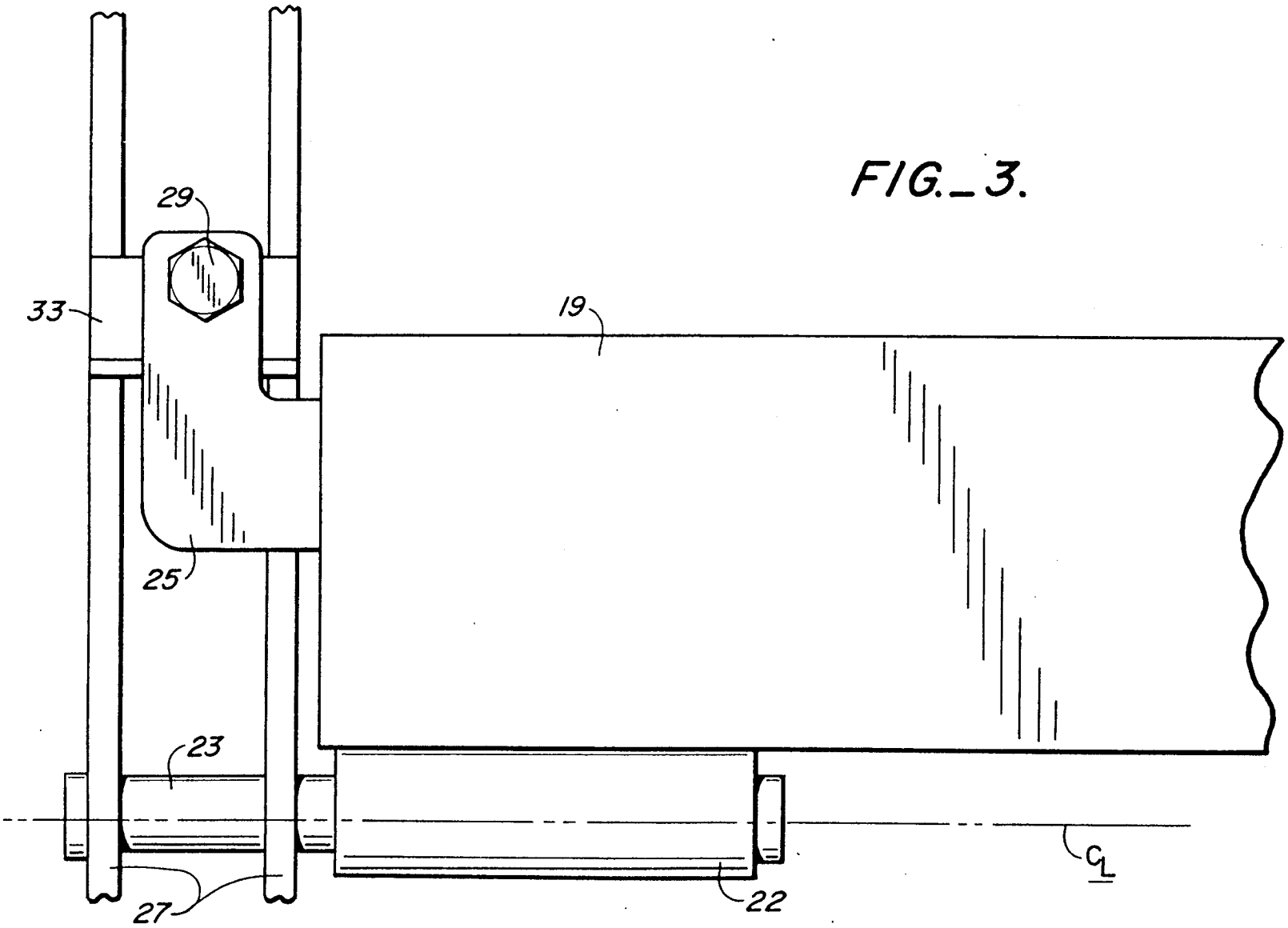
FIG. 3 is a broken-out portion in top plan view illustrating the end of a lifting spreader central beam and its connection to the respective end cross-member.
Figure 4:
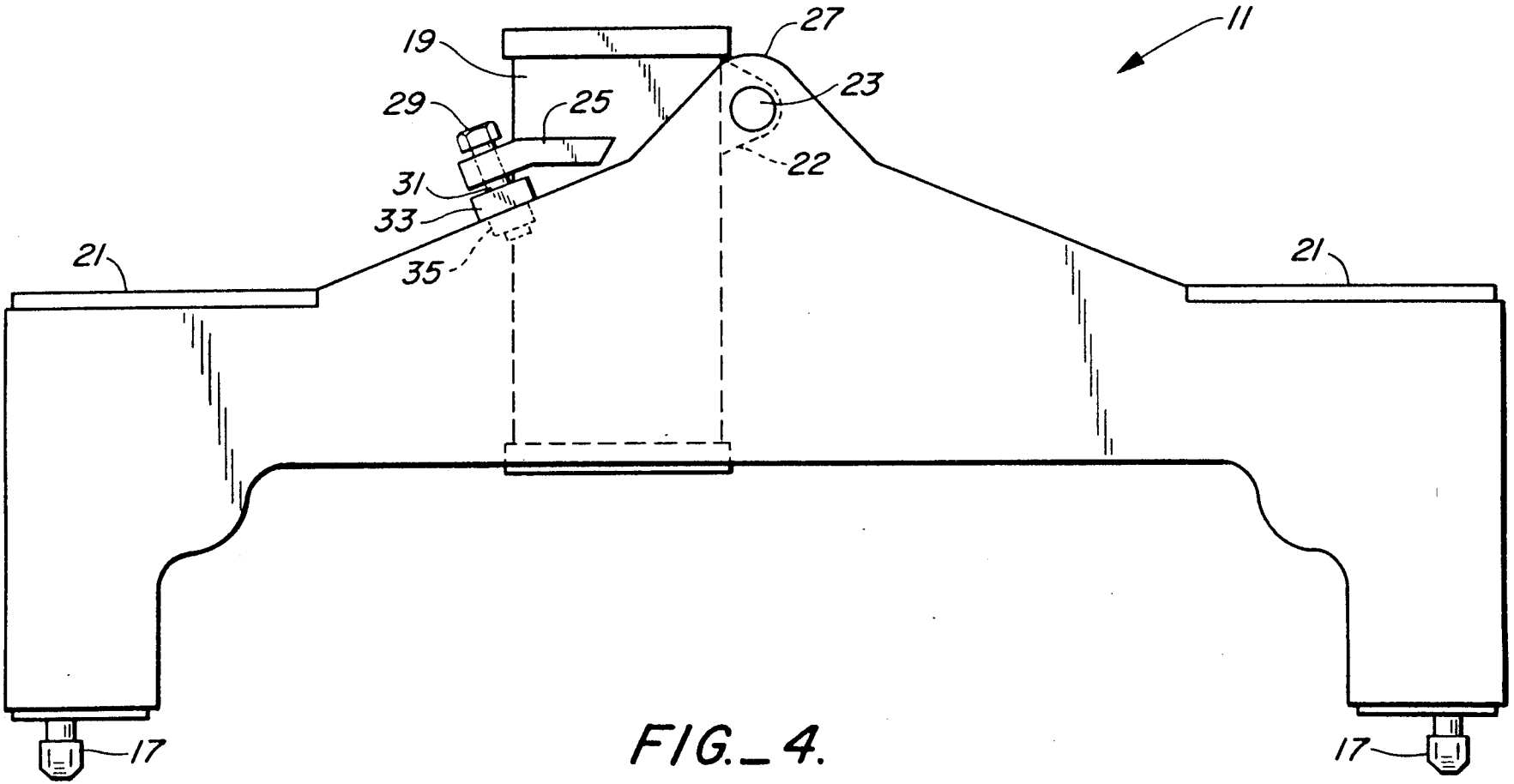
FIG. 4 is an end elevation of FIG. 1.
Figure 5:
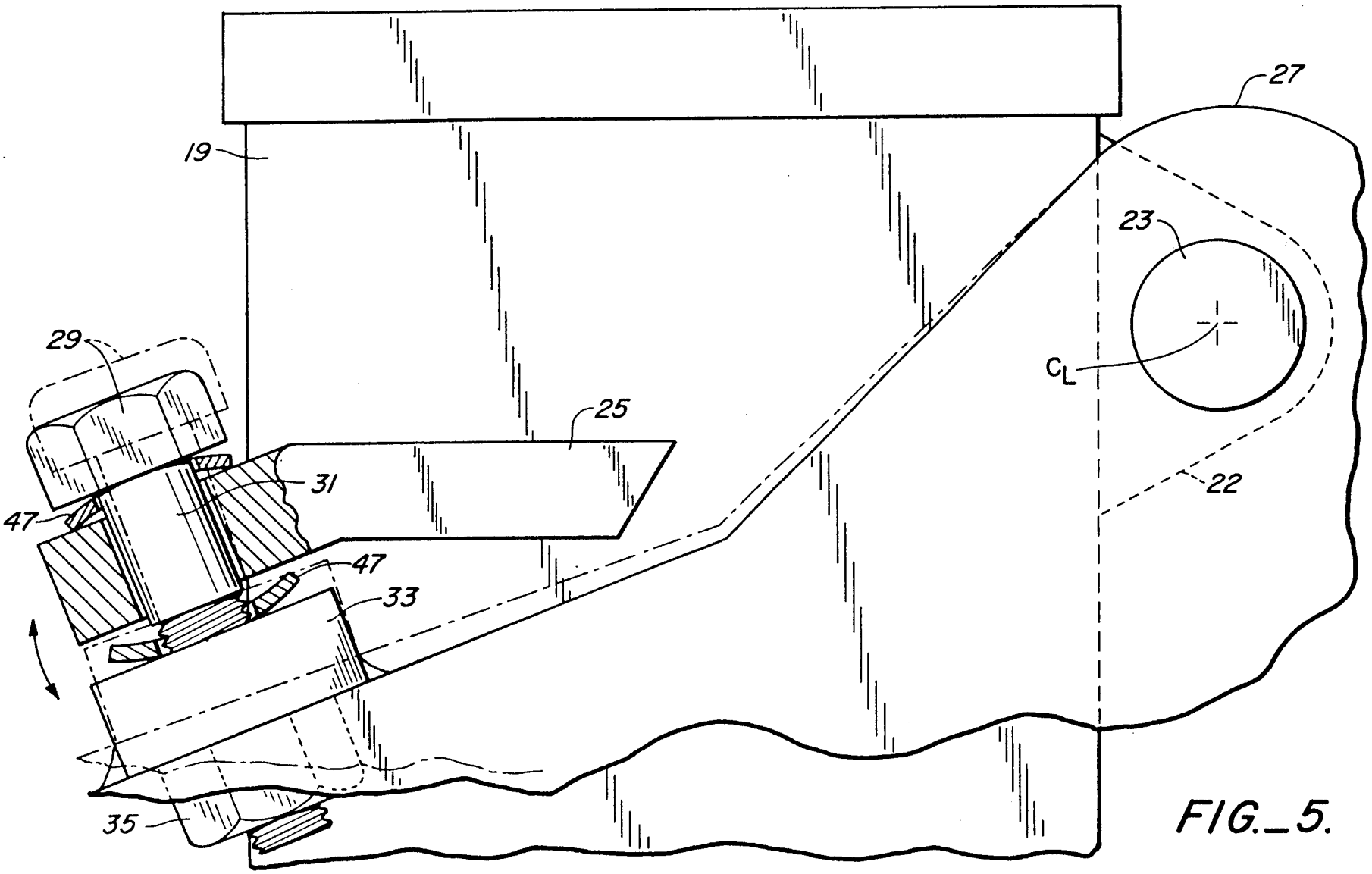
FIG. 5 is a broken-out portion in end elevation showing one of the cantilevered projecting arms which are secured to the lifting beam and limit the rotation of the cross-members with respect to the main beam of the lifting spreader.

The restrictor means includes cantilevered projecting arms 25 shown in FIG. 2 which are secured to the central beam 19 and project therefrom with their free ends disposed at terminal positions proximate to the cross-members 21. The arms can be made of spring steel to allow for some flexibility and resistance in the event stress is placed on the arms. A further means is provided which interconnects the arms to the cross-members allowing limited movement of the cross-members relative to the projecting arms. If the design of the spreader prevents mounting the pivot connection at the center of gravity of the cross-members, as might be the case with extensible lifting spreader designs, the restrictor means will limit rotation of the cross-member, caused by the unbalanced moment, to the desired tolerances.

In the preferred embodiment of the present invention, the cross-members 21 of the lifting spreader 11 include a pair of upward projecting flanges 27 which are disposed preferably at the centerline of the spreader and are secured to the central beam 19 by a journal shaft which projects therethrough with a rotatable connection 23 having an axis of rotation parallel to the longitudinal axis of the beam. The projecting arms 25 of the restrictor means are secured to the central beam and the free ends of the arms are captured between adjustable limit stops secured to the cross-members.

In a preferred embodiment, the limit stops of the restrictor means include a bolt 29 which extends through a hole 31 in the ends of the projecting arms 25 and is threadably engaged with the cross-member 21 by means of a threaded cross-piece 3 secured to the cross-member whereby tightening or loosening of the bolt decreases or increases the amount of movement permitted by the projecting arm with respect to the cross-member. A locknut 35 is provided to fix the position of the bolt in its engagement with the cross-member. It tightens onto the bolt from the bottom side of the cross-piece.

As a result of restricting the movement of the projecting arm 25, the amount of rotation of the cross-member 21 relative to the central beam 19 is also restricted. In addition to tightening o loosening the bolt 29 to increase or decrease the amount of relative rotation allowed to the cross-member, the bolt can be removed to free the cross-member for greater rotation when required or the bolt tightened down to in effect lock up or restrain the rotational capability of the mechanism. Resilient shims 47 can be inserted between the arm and the cross-member and between the bolt head and the arm to absorb the shock due to normal operation whereby excessive stress is absorbed rather than transmitted to the restrictor mechanism when it is in a locked condition. The effect of the shims is to dampen the rotational motion of the cross-members. The resiliency of the shims and the spring in the arm allow the cross-members to rotate sufficiently to provide the desired vertical motion tolerances for the twistlock lug members.

The features of the present invention solve the problems of the prior art. The rotational capability of the end cross-members allow the twistlock lug members to hang level in the same plane for engaging containers and to rotate in a vertical plane to accommodate to damaged containers. The same capability also equalizes the loads on the lug members to equalize their life expectancies. Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may been necessitated by the appended claims.

We claim:

1. A cargo container lifting spreader compensating mechanism comprising a lifting spreader having a central lifting beam and a pair of cross-members disposed at the opposite ends of the central lifting beam, at least one of said cross-members being secured to said beam with a journaled connection allowing at least partial rotation of said cross-member in a plane perpendicular to the longitudinal axis of said beam, said cross-members having twistlock lug members mounted proximate to the lower ends thereof for mating with the twistlock engagement receptacles in the corner castings of a cargo container, and a restrictor means preventing excessive rotation of the rotatable cross-member with respect to said central beam at least when said spreader is in the process of engaging a cargo container, said restrictor means including a cantilevered projecting arm secured to said central beam and projecting therefrom with its free end disposed at a terminal position proximate to said rotatable cross-member and captured between adjustable limit stops secured to said cross-member at a position displaced from the axis rotation of said journal connection thereby allowing limited rotational movement of the cross-member relative to said projecting arm and to said central beam.

2. The lifting spreader compensating mechanism of claim 1 wherein each of the cross-members include a pair of upward projecting flanges which are disposed at the center of gravity of the cross-members and are secured to the central beam by a journal shaft with a rotatable connection having an axis of rotation parallel to the longitudinal axis of said beam whereby both of said cross-members are partially rotatable with respect to said central beam, and said restrictor means includes a pair of cantilevered projecting arm disposed at opposite ends of said beam and secured to the central beam at a position with their free ends disposed between said flanges and captured between adjustable limit stops secured to said cross-members at positions displaced from the rotational axis of said cross-members.

3. The lifting spreader compensating mechanism of claim 2 wherein the limit stops of said restrictor means include a bolt which extends through a hole in the ends of said projecting arm and is threadably engaged with said rotatable cross-member whereby tightening or loosening of said bolt decreases or increases the amount of movement permitted to the projecting arm with respect to said cross-member and thereby the amount of rotation of said cross-member relative to said central beam.

4. The lifting spreader compensating mechanism of claim 3 wherein the rotational motion of the cross-members is dampened by resilient shims disposed between the cross-member and said projecting arm and between said bolt head and said arm and when said bolt is tightened to compress said shims until the desired degree of limited rotational motion is obtained.

5. A cargo container lifting spreader compensating mechanism comprising, a lifting spreader having a central lifting beam and a pair of cross-members disposed at the opposite ends of the central lifting beam and secured thereto with journaled connections allowing at least partial rotation of the cross-members in a plane perpendicular to the longitudinal axis of said beam, said cross-members having twistlock lug members mounted proximate the lower ends thereof for mating with the twistlock receptacles formed in the top corner castings of a cargo container, said cross-members including a pair of upward projecting flanges which are disposed at the center of gravity of the cross-members and are secured to the central beam by journal shafts with rotatable connections having axes of rotation parallel to the longitudinal axis of said beam, cantilevered projecting arms secured to said central beam and projecting therefrom with their free ends disposed at terminal positions proximate to said cross-members, a bolt extending through a hole in the ends of said projecting arms and being threadably engaged with said cross-member, said bolts interconnecting said arms to said cross-members in a captured relation whereby tightening or loosening of said bolt increases or decreases the amount of movement permitted to the projecting arm with respect to said cross-member and thereby the amount of rotation of said cross-member relative to said central beam whereby said arms are captured between adjustable limit stops allowing limited movement of the cross-members relative to said projecting arms and thereby limited rotation of said cross-members relative to said central beam, and resilient shims disposed between the cross-members and said projecting arms and between said bolt heads and said arms whereby said bolts can be tightened to adjustably dampen the rotational motion of said cross-members.

* * * * *